US006186094B1

(12) United States Patent
Kamdar

(10) Patent No.: US 6,186,094 B1
(45) Date of Patent: Feb. 13, 2001

(54) SABOT ANTI-SPLITTING RING

(75) Inventor: Dipak S. Kamdar, Maple Grove, MN (US)

(73) Assignee: Alliant Techsystems Inc., Hopkins, MN (US)

( * ) Notice: Under 35 U.S.C. 154(b), the term of this patent shall be extended for 0 days.

(21) Appl. No.: 09/140,512

(22) Filed: Aug. 26, 1998

(51) Int. Cl.[7] ..... F42B 13/16
(52) U.S. Cl. ..... 119/520
(58) Field of Search ..... 102/520, 517, 102/516, 521, 528, 439

(56) References Cited

U.S. PATENT DOCUMENTS

| | | | | |
|---|---|---|---|---|
| H165 | * | 11/1986 | Silsby | 102/520 |
| 4,215,632 | * | 8/1980 | Sie | 102/92.7 |
| 4,546,705 | * | 10/1985 | Langenohl et al. . | |
| 4,603,636 | * | 8/1986 | Wallow . | |
| 4,823,703 | * | 4/1989 | Donaldson . | |
| 4,867,067 | * | 9/1989 | Becker et al. . | |
| 5,103,735 | * | 4/1992 | Kaste et al. . | |
| 5,635,660 | | 6/1997 | McGovern | 86/21 |
| 5,640,054 | | 6/1997 | McGovern | 264/3.1 |
| 5,747,725 | | 5/1998 | Stewart et al. | 102/521 |
| 5,789,699 | * | 8/1998 | Stewart et al. . | |

FOREIGN PATENT DOCUMENTS

| | | | | |
|---|---|---|---|---|
| 1401792 | * | 4/1965 | (FR) | 102/520 |
| 2343218 | * | 9/1977 | (FR) | 102/520 |
| 2251676 | * | 7/1991 | (GB) . | |

* cited by examiner

*Primary Examiner*—Thomas Price
(74) *Attorney, Agent, or Firm*—George A. Leone; Mark Goldberg

(57) ABSTRACT

A composite sabot including an anti-splitting ring connected to the composite sabot body, to prevent the sabot from splitting during discard. The composite sabot includes sabot petals with fibers oriented in the radial direction and a front scoop for gathering air particles. The anti-splitting ring is mounted to the front scoop portion of the composite sabot where splitting initiates. The anti-splitting ring may be a variety of shapes and materials and attaches easily and inexpensively to any sabot.

20 Claims, 4 Drawing Sheets

SABOT ANTI-SPLITTING RING

U.S. GOVERNMENT RIGHTS

The United States Government has certain rights to this invention under government contract number DAAE30-97-C-1006.

FIELD OF THE INVENTION

The present invention is generally related to sabots, and more particularly to a composite sabot with an anti-splitting ring integral therewith.

BACKGROUND OF THE INVENTION

In military ordnance arts, carriers for projectiles, known as sabots, have been used to facilitate the use of a variety of munitions while engaging in military operations.

In general, a sabot is a lightweight carrier for a projectile that permits the firing of a variety of projectiles of a smaller caliber within a larger caliber weapon. The word sabot is derived form the French word cabot, which means, "shoe." Because a sabot fits around the projectile in a manner similar to the way a cabot, or "shoe," slips onto a persons foot, the name has been applied to all such projectile carriers.

A sabot provides structured support to a flight projectile within a gun tube under extremely high loads. Without adequate support from a sabot, a projectile may break up into many pieces when fired.

A sabot fills the bore of the gun tube while encasing the projectile to permit uniform and smooth firing of the weapon. The projectile is centrally located within the sabot that is generally radially symmetrical. After firing, the sabot and projectile clear the bore of the gun tube and the sabot is normally discarded some distance from the gun tube while the projectile continues toward the target.

One method for discarding a sabot is to form a scoop onto the sabot. After the sabot and projectile clear the weapon bore, the scoop gathers, or "scoops," air particles as it is moving forward. The air pressure on the front scoop lifts the sabot from the projectile and thus the sabot is removed from the projectile in flight, allowing the projectile to continue towards its target.

Additionally, sabots are generally made in three symmetrical segments to facilitate smooth discard upon exit from the gun. Typically, each segment, or petal, spans 120 degrees of the front circumference of the intact sabot. Each petal's scoop portion is still expansive enough, at 120-degrees, to serve its purpose of driving the petal away from the projectile. The three segment design allows sabot petals to discard from the projectile quickly, as opposed to, for example, a design where an intact sabot gradually slips off of the projectile. The overall advantage of a three petal sabot design is that the sabot is released more quickly, thereby reducing parasitic weight and increasing accuracy.

It is desirable to make sabots lightweight to increase the muzzle velocity of projectile at exit. At the same time, the sabot must maintain its rigidity during operation. For example, inside the bore of the weapon the sabot must stay rigid to allow smooth firing and accurate targeting. Further, once outside the bore of the weapon, the sabot must maintain rigidity in order to scoop air particles efficiently, discard its three petals, and allow acceptable projectile dispersion on the target.

The weight of sabots has been reduced considerably through the use of continuous fiber composite material. Generally, such composite sabots are mixtures of fibers and epoxy combined in a chemical molding process. The weight reductions are made possible by aligning the fibers in the longitudinal/radial plane of the sabot which matches the load directions generated during the projectile travel down the weapon bore.

Unfortunately, during sabot discard, significant circumferential, or hoop, tensile loads are created. Since no fibers are oriented in the circumferential, or hoop, direction in known lightweight sabot designs, the sabot splits along the longitudinal/radial plane typically near the middle of the sabot scoop. Compounding the problem, a faulty molding process may leave air voids in the structure of the sabot, which increases the probability that a sabot petal of conventional design will split into more than two pieces.

Consequently, composite sabot petals of conventional design usually split in the middle from the high hoop stresses generated during discard. Thus, a 120-degree petal may split into two 60-degree segments due to the lack of strength in the circumferential direction of the sabot. This could result in asymmetric discard, where the petals are released at different times, and poor projectile dispersion on the target. It also has been found that a 60-degree segment of split sabot petal is more likely to fail in the scoop or break in the saddle compared to 120-degree intact sabot petal. Further, such splits occur with considerable variation in the location and time of splitting. Thus, compensation for the sabot failure using targeting adjustments is very difficult.

Previous attempts to stop the splitting of composite sabots involved filament wrapping. In this process, the entire assembled projectiles are wrapped with filaments, and then the filament wrap is slit along the seams between the sabot petals. However, this process is unwieldy and expensive from a manufacturing standpoint. Further, filament wrapping is known to be ineffective for preventing all sabot splitting problems.

SUMMARY OF THE INVENTION

The present invention overcomes the deficiencies of the prior art by, for the first time, providing a lightweight, reliable, and inexpensive method of eliminating splitting of a composite sabots during discard using an anti-splitting ring within a composite sabot. The present invention provides a composite sabot that discards more uniformly thereby allowing increased accuracy and dispersion of projectiles fired with composite sabots. Further, the present invention provides a composite sabot design that decreases the drag on and increases velocity of a projectile fired with composite sabots.

The invention provides, for the first time, a composite sabot having an anti-splitting ring mounted to the sabot to prevent the composite sabot from splitting during discard.

In one example embodiment of the invention, a composite sabot includes sabot petals with fibers oriented in the radial direction and a front scoop for gathering air particles. An anti-splitting ring is mounted to the front scoop portion of the composite sabot where splitting initiates. The anti-splitting ring may be a variety of shapes and materials and attaches easily and inexpensively to any sabot.

Other objects, features and advantages of the present invention will become apparent to those skilled in the art through the description of the preferred embodiment, claims and drawings wherein like numerals refer to like elements.

DETAILED DESCRIPTION OF THE INVENTION

Figure 1:
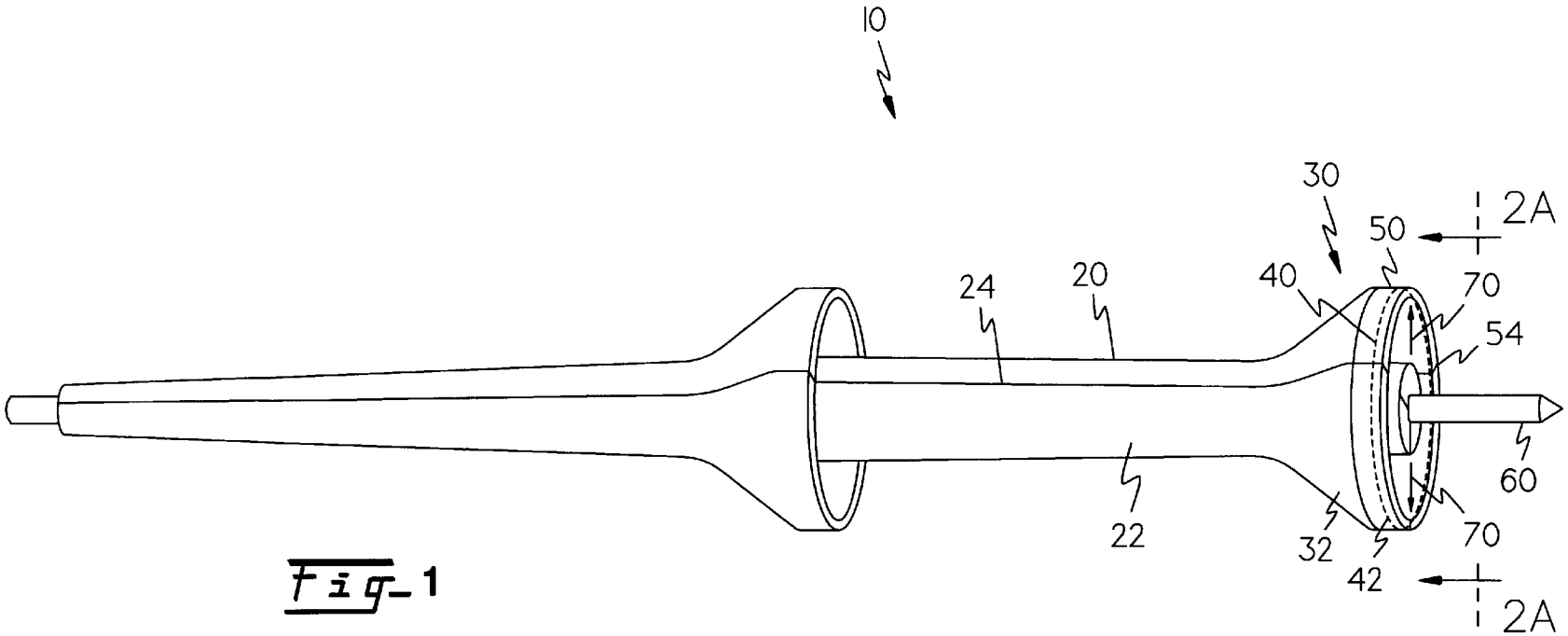
FIG. 1 is a three dimensional perspective view of one example of the apparatus of the invention employed on a composite sabot.

Illustrated in FIG. 1 is a three dimensional perspective view of a composite sabot 10 in accordance with the present invention. The composite sabot 10 has a sabot body 20, an anti-splitting ring 50, and a penetrator 60.

The sabot body 20 has a front scoop 30 for trapping air particles. The front scoop has a front edge 40 for mounting the anti-splitting ring 50. In this example of the present invention, the sabot body 20 is nominally radially divided along three petal divisions 24 into three 120-degree sabot petals 22. Each sabot petal 22 has a front scoop segment 32. Each front scoop segment 32 has a front edge segment 42. Accordingly, the anti-splitting ring 50 is also nominally divided along three ring divisions 54 into three 120-degree anti-splitting ring segments 52 (shown in FIG. 2B). In one useful embodiment, the petal divisions 24 and the ring divisions 54 are advantageously aligned so that one ring segment 52 substantially covers a mating front edge segment 42. Fully assembled, the sabot petals 22 and the anti-splitting ring segments 52 encompass the penetrator 60.

When fired, and after the composite sabot 10 exits from a gun tube, the sabot body 20 releases the penetrator 60. Release occurs as the front scoop 30 traps or "scoops" air particles. The air particles create lift forces 70 that separate the sabot body 20, along the petal divisions 24, into its corresponding sabot petals 22. Accordingly, as the sabot body 20 separates, the anti-splitting ring 50 also separates along the ring divisions 54. As the sabot petals 22 are separating, the front scoop segments 32 provide enough surface area to allow total separation from and release of the penetrator 60. This release process is called discard.

Figure 2B:
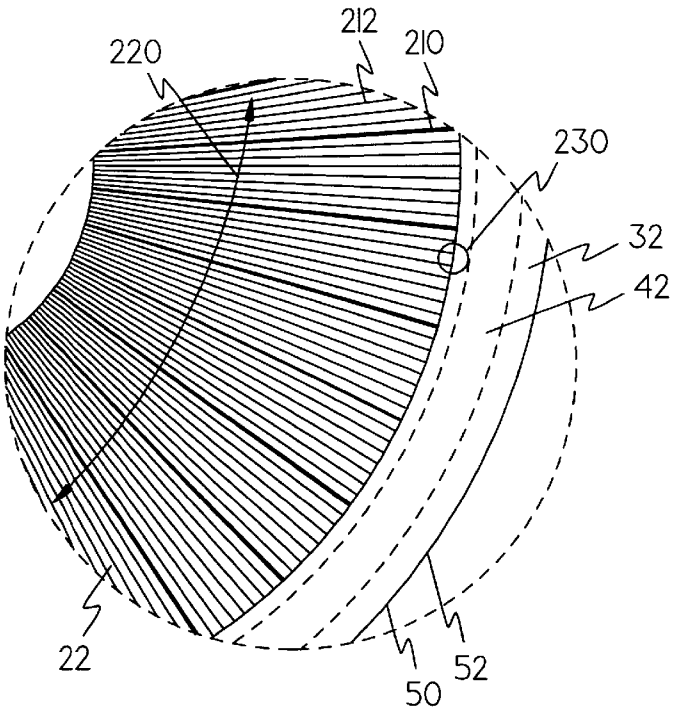
FIG. 2B is a partial view of one example of the apparatus of the invention as depicted in FIG. 2A.
Figure 2A:
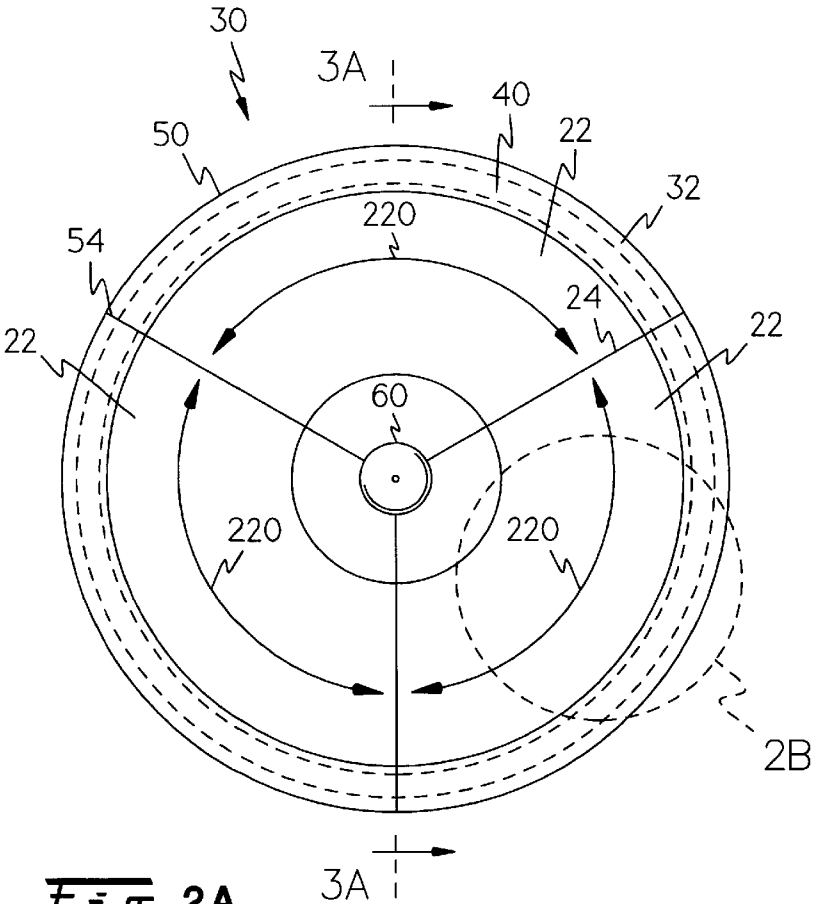
FIG. 2A is a front view of one example of the apparatus of the invention employed on a composite sabot.

Illustrated in FIG. 2A is a front view of the front scoop 30 of a composite sabot of the present invention taken generally along the line 2A—2A of FIG. 1. This view shows the front scoop 30 with the front edge 40. The anti-splitting ring 50 is mounted on the front edge 40, and thus, hides the front edge 40 from view. The anti-splitting ring 50 may be integrally connected to the front edge 40 or mounted using a wide variety of known structural adhesives. This view more clearly shows that the ring divisions 54 are aligned with the petal divisions 24 and that the fully assembled sabot petals encompass the penetrator 60.

Further, FIG. 2A shows the high hoop stresses 220 that are generated on the front scoop segments 32 during discard. The anti-splitting ring 50 prevents the hoop stresses 220 from splitting the front edge segments 42 (shown in FIG. 1 and 2B) of the sabot petals 22 throughout the entire discard process.

Illustrated in FIG. 2B is a detailed partial view of the front scoop segment 32 of FIG. 2A. Front scoop segment 32 has wedges 210 aligned in the radial direction. Each wedge 210 is comprised of wedge fibers 212 aligned in the same direction as the wedges 210. The radial alignment of the wedges 210 matches loads created during the firing of the composite sabot 10.

However, during discard, the high hoop stresses 220 generate loads in the circumferential direction; thus, the wedges 210 are not oriented in the proper direction to withstand the hoop stresses 220. Consequently, the wedges 210 begin to split. In other mechanisms built without the benefit of the anti-splitting ring of the invention, splitting would initiate in the middle of a front edge segment 42 at split point 230 and travel down the length of the sabot petal 22 as the wedges 210 progressively fail.

Further, in such other devices, when splitting occurs, it also has been found that the front scoop segment 32 will fail to provide sufficient trapping of air particles after the sabot petals 22 have begun to separate. Consequently, discard could be asymmetric or the sabot petals 22 could break.

As mentioned hereinabove, the anti-splitting ring 50 of the invention advantageously prevents the hoop stresses 220 from splitting the front edge segments 42. The anti-splitting ring 50 prevents splitting because it is oriented in the same direction as the hoop stresses 220 and provides the wedge fibers 212 with sufficient circumferential strength to withstand splitting. The anti-splitting ring segments 52 also prevent the front scoop segments 32 from splitting, to allow for proper release of the penetrator 60 throughout the discard process.

Figure 3B:
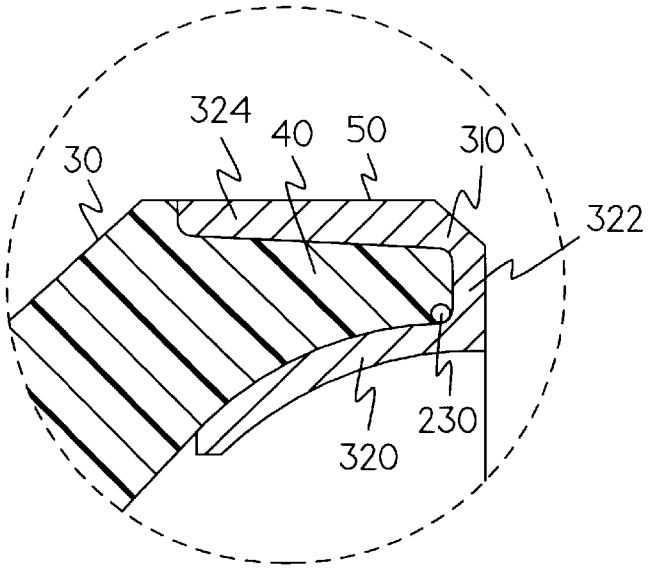
FIG. 3B is a partial view of one example of the apparatus of the invention as depicted in FIG. 3A.
Figure 3A:
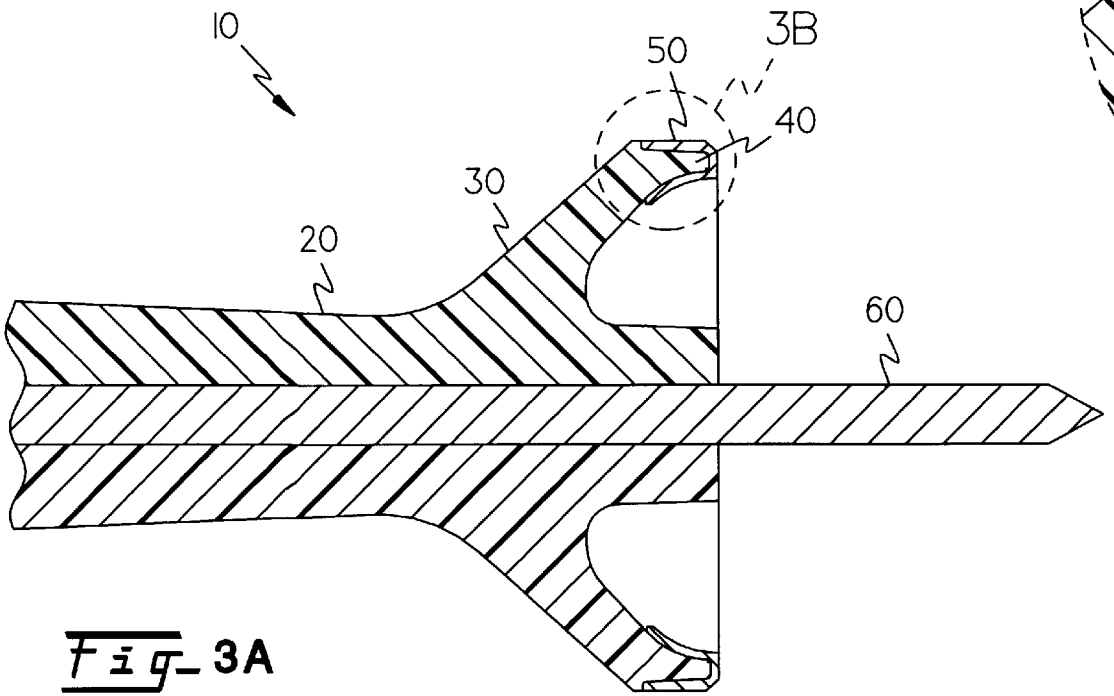
FIG. 3A is a cross-sectional side view of one example of the apparatus of the invention employed on a composite sabot.

Illustrated in FIG. 3A is a cross-sectional view of the composite sabot 10 of the present invention taken generally along the line 3A—3A of FIG. 2A. This view shows a portion of sabot body 20, anti-splitting ring 50, and a portion of penetrator 60. The anti-splitting ring 50 is mounted to the front edge 40 of front scoop 30.

Illustrated in FIG. 3B is a detailed partial view of the front scoop 30 of FIG. 3. This view shows front scoop 30 with front edge 40. The anti-splitting ring 50 is mounted to front edge 40. In this example of the present invention, the anti-splitting ring 50 has a U-shaped cross-section 310.

The anti-splitting ring 50 of FIG. 3A has a first bottom wall 320, a first front wall 322, and a top wall 324 that combine to form the U-shape cross-section 310 of this example of the anti-splitting ring 50. The U-shape cross-section 310 allows the anti-splitting ring 50 to easily mate with the front edge 40 providing circumferential strength to front scoop 30 and the wedge fibers 212 (as shown in FIG. 2B). The anti-splitting ring 50 with the U-shape cross-section 310 also reinforces and encloses the split point 230.

Figure 4B:
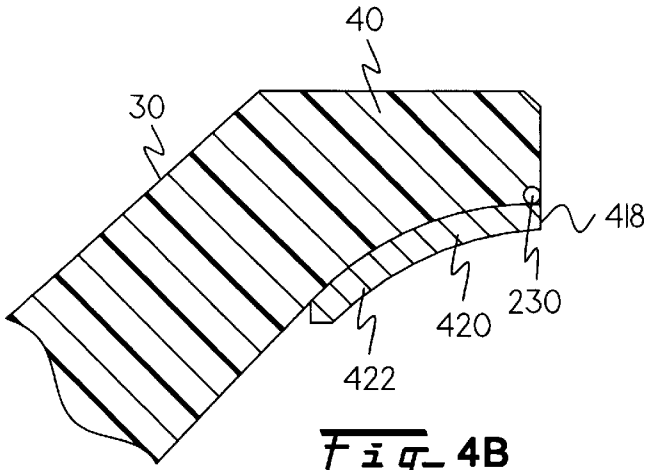
FIG. 4B is a partial cross-sectional side view of an alternative example of the apparatus of the invention employed on a composite sabot.
Figure 4A:
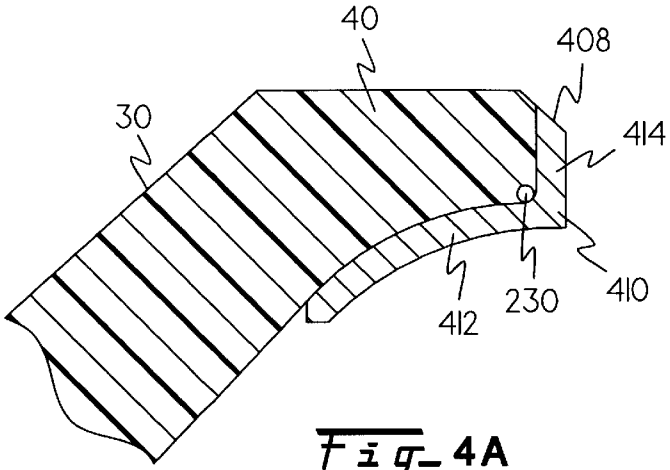
FIG. 4A is a partial cross-sectional side view of an alternative example of the apparatus of the invention employed on a composite sabot.

Illustrated in FIG. 4A is an alternate embodiment of the present invention with a detailed partial view of the front scoop 30 with a second anti-splitting ring 408. This view shows front scoop 30 with front edge 40. A second anti-splitting ring 408 is mounted to front edge 40. In this example of the present invention, the second anti-splitting ring 408 has an L-shaped cross-section 410.

The second anti-splitting ring 408 of FIG. 4A has a second bottom wall 412 and a second front wall 414 that combine to form the L-shape cross-section 410 of the second anti-splitting ring 408. The L-shape cross-section 410 allows the second anti-splitting ring 408 to easily couple with the front edge 40 providing circumferential strength to front scoop 30 and the wedge fibers 212 (as shown in FIG. 2B). The second anti-splitting ring 408 with the L-shape cross-section 410 also reinforces and encloses the split point 230.

Illustrated in FIG. 4B is an alternate embodiment of the present invention with a detailed partial view of the front scoop 30 with a third anti-splitting ring 418. This view shows front scoop 30 with front edge 40. The third anti-splitting ring 418 is mounted to front edge 40. In this example of the present invention, the third anti-splitting ring 418 has a curved cross-section 420.

The third anti-splitting ring 418 of FIG. 4B has a first single wall 422 that forms the curved cross-section 420 of this example of the third anti-splitting ring 418. The curved cross-section 420 allows the third anti-splitting ring 418 to connect with the front edge 40 providing circumferential strength to front scoop 30 and the wedge fibers 212 (as shown in FIG. 2B). The third anti-splitting ring 418 with the curved cross-section 420 also reinforces the split point 230.

Figure 4C:
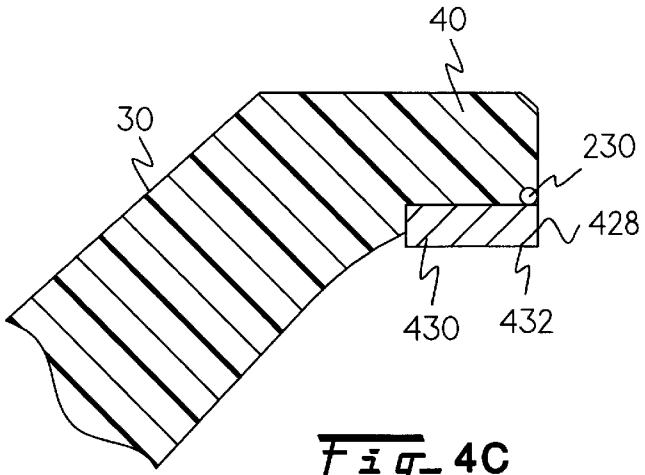
FIG. 4C is a partial cross-sectional side view of an alternative example of the apparatus of the invention employed on a composite sabot.

Illustrated in FIG. 4C is an alternate embodiment of the present invention with a detailed partial view of the front scoop 30 with a fourth anti-splitting ring 428. This view shows front scoop 30 with front edge 40. The fourth anti-splitting ring 428 is mounted to front edge 40. In this example of the present invention, the fourth anti-splitting ring 428 has a rectangular cross-section 430.

The fourth anti-splitting ring 428 of FIG. 4C has a second single wall 432 that forms the rectangular cross-section 430 of this example of the fourth anti-splitting ring 428. The rectangular cross-section 430 allows the fourth anti-splitting ring 428 to connect with the front edge 40 providing circumferential strength to front scoop 30 and the wedge fibers 212 (as shown in FIG. 2B). The fourth anti-splitting ring 428 with the rectangular cross-section 430 also reinforces the split point 230.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different equipment and devices, and that various modifications, both as to the equipment details and operating procedures, may be accomplished without departing from the true spirit and scope of the present invention.

More specifically, materials for anti-splitting ring 50 may be chosen from a wide array of materials to serve the intended purpose. The material may be selected from a wide array of metallic materials and alloys, as well as, composite fiber, thermoset or thermoplastic resins and epoxies to serve the intended function and accommodate manufacturing processing to achieve the integral structure as indicated herein. Other resins known to one skilled in the art may be employed as appropriate, For example, the anti-splitting ring of the invention may advantageously be comprised of material selected from the group consisting of metal, a continuous fiber/epoxy system, a chopped fiber/epoxy system, a thermoset fiber/epoxy system, a thermoplastic fiber/epoxy system, a continuous thermoset fiber/epoxy system, a chopped thermoset fiber/epoxy system, a continuous thermoplastic fiber/epoxy system, a chopped thermoplastic fiber/epoxy system, a thermoset fiber/resin system, a thermoplastic fiber/resin system, a continuous thermoset fiber/resin system, a chopped thermoset fiber/resin system, a continuous thermoplastic fiber/resin system, and a chopped thermoplastic fiber/resin system.

As a further example, fibers employed for making the anti-splitting ring may advantageously include glass fibers, graphite fibers, carbon fibers, boron fibers or any other fibrous materials suitable for making lightweight anti-splitting rings. Suitable metals include aluminum, and any other suitable metal or metal alloys. The anti-splitting ring may be shaped and manufactured using any well known machining or other fabrication techniques from the metal arts or the composite fiber arts as the case may be.

Lastly, the anti-splitting ring 50 may have many possible configurations in addition to those configurations shown in FIGS. 3B and FIGS. 4A–4C. These and other modifications are all intended to be within the true spirit and scope of the present invention.

What is claimed is:

1. An anti-splitting ring for a composite sabot having a front scoop with a front edge, wherein said anti-splitting ring is mounted on said front edge and said anti-splitting ring comprises a plurality of ring segments.

2. The anti-splitting ring of claim 1 wherein said anti-splitting ring further comprises a U-shaped cross-section.

3. The anti-splitting ring of claim 1 wherein said anti-splitting ring further comprises an L-shaped cross-section.

4. The anti-splitting ring of claim 1 wherein said anti-splitting ring further comprises a rectangular cross-section.

5. The anti-splitting ring of claim 1 wherein said anti-splitting ring further comprises a curved cross-section.

6. The anti-splitting ring of claim 1 wherein said anti-splitting ring further comprises a U-shaped cross-section.

7. The anti-splitting ring of claim 1 wherein said anti-splitting ring further comprises an L-shaped cross-section.

8. The anti-splitting ring of claim 1 wherein said anti-splitting ring further comprises a metal ring.

9. The anti-splitting ring of claim 1 wherein said anti-splitting ring is comprised of material selected from the group consisting of metal, a continuous fiber/epoxy system, a chopped fiber/epoxy system, a thermoset fiber/epoxy system, a thermoplastic fiber/epoxy system, a continuous thermoset fiber/epoxy system, a chopped thermoset fiber/epoxy system, a continuous thermoplastic fiber/epoxy system, a chopped thermoplastic fiber/epoxy system a thermoset fiber/resin system, a thermoplastic fiber/resin system, a continuous thermoset fiber/resin system, a chopped thermoset fiber/resin system, a continuous thermoplastic fiber/resin system, a chopped thermoplastic fiber/resin system, and aluminum.

10. A composite sabot comprising:

(a) a plurality of sabot petals;

(b) a plurality of front scoop segments integrally connected to said sabot petals;

(c) a plurality of front edge segments integrally connected to said front scoop segments;

(d) an anti-splitting ring mounted on said front edges, wherein said anti-splitting ring comprises a plurality of ring segments; and (e) a penetrator encompassed within said sabot petals.

11. The composite sabot of claim 10 wherein said anti-splitting ring further comprises a U-shaped cross-section.

12. The composite sabot of claim 10 wherein said anti-splitting ring further comprises an L-shaped cross-section.

13. The composite sabot of claim 10 wherein said anti-splitting ring further comprises a rectangular cross-section.

14. The composite sabot of claim 10 wherein said anti-splitting ring further comprises a curved cross-section.

15. A method of fabricating a composite sabot, comprising the steps of:

(a) fabricating a plurality of sabot petals using fibers and thermoset or thermoplastic resins;

(b) simultaneously fabricating a plurality of front scoop segments, each front scoop segment integrally connected to one of said sabot petals;

(c) simultaneously fabricating a plurality of front edge segments, each front edge segment integrally connected to one of said front scoop segments;

(d) assembling the sabot segments around a penetrator;

(e) fabricating an anti-splitting ring; and (f) mounting said anti-splitting ring on said front edge segments.

16. The composite sabot of claim 15 further comprising the step of fabricating said anti-splitting ring with a plurality of ring segments.

17. The composite sabot of claim 15 further comprising the step of fabricating said anti-splitting ring with a U-shaped cross-section.

18. The composite sabot of claim 15 further comprising the step of fabricating said anti-splitting ring with an L-shaped cross-section.

19. The composite sabot of claim 15 further comprising the step of fabricating said anti-splitting ring with a rectangular cross-section.

20. The composite sabot of claim 15 further comprising the step of fabricating said anti-splitting ring with a curved cross-section.

* * * * *